United States Patent [19]

Nissen

[11] Patent Number: 4,729,599

[45] Date of Patent: Mar. 8, 1988

[54] BLEACHER CUSHIONS

[75] Inventor: George P. Nissen, Cedar Rapids, Iowa

[73] Assignee: Gymnasium Protection Systems, Inc., Cedar Rapids, Iowa

[21] Appl. No.: 7,333

[22] Filed: Jan. 27, 1987

[51] Int. Cl.[4] ..... A47C 27/00

[52] U.S. Cl. ..... 297/219; 297/283

[58] Field of Search ..... 297/219, 226, 382, 283, 297/223, 229, 252; 52/8, 9

[56] References Cited

U.S. PATENT DOCUMENTS

| | | | |
|---|---|---|---|
| 1,153,120 | 9/1915 | Lackey . | |
| 1,997,027 | 4/1935 | Wittcoff | 297/382 |
| 2,205,624 | 6/1940 | Horn . | |
| 2,475,962 | 7/1949 | Horn | 297/252 |
| 2,497,698 | 2/1950 | Struble et al. | 297/220 |
| 2,706,835 | 4/1955 | Ullom . | |
| 2,715,434 | 8/1955 | Lukens | 297/283 |
| 2,763,875 | 9/1956 | Piontkowski | 297/223 X |
| 2,815,541 | 12/1957 | Lappin et al. . | |
| 2,846,738 | 8/1958 | Walworth et al. . | |
| 2,865,433 | 12/1958 | Warner | 297/252 X |
| 2,983,968 | 5/1961 | Wurn . | |
| 2,987,111 | 6/1961 | Walworth | 52/9 |
| 3,088,176 | 5/1963 | Delf et al. . | |
| 3,266,545 | 8/1966 | Kruissink | 297/219 |
| 3,284,819 | 11/1966 | Nissen . | |
| 3,353,867 | 11/1967 | Anderson | 297/219 |
| 3,606,461 | 9/1971 | Moriyama | 297/283 |
| 3,667,171 | 6/1972 | McClelland . | |
| 4,190,918 | 3/1980 | Harvell | 297/219 |

*Primary Examiner*—Francis K. Zugel

*Attorney, Agent, or Firm*—Simmons, Perrine, Albright & Ellwood

[57] ABSTRACT

A pair of cushions are hinged to each other and also hingedly attachable to retractable bleachers such that the cushions hang down to form a wall of protective padding over the front of the bleachers when retracted, but when the bleachers are extended the cushions can be flipped-up on top of the seats for spectators to sit on.

5 Claims, 4 Drawing Figures

BLEACHER CUSHIONS

BACKGROUND OF THE INVENTION

Many if not most gymnasiums in schools and the like include foldable or retractable bleachers along one or more gymnasium walls which when folded or retracted present a more or less vertical face. When pulled out for use the bleachers provide ascending tiers of seats for spectators. The seats are usually relatively narrow lengths of wood or other hard material lacking in comfort for those who must sit on them unless cushions are separately supplied or brought to the occasion.

Gymnasium walls are often provided with padding up to a height of six or so feet in order to protect athletes, such as basketball players, from injury. For the same reason the 37 walls" formed by folded or retracted bleachers bounding the playing area are sometimes padded, which padding must be removed before the bleachers can be pulled out for use.

SUMMARY OF THE INVENTION

The present invention provides sets of foldable cushions which are secured to the front edges of the bleacher seats. The cushions are constructed in such a manner that when the bleachers are folded or retracted the cushions hand down to provide protective padding completely covering the otherwise exposed faces of the bleachers. But when the bleachers are pulled out for use, the cushions fold back up on top of the bleacher seats for spectators to sit on.

The cushions can be supplied in school colors or otherwise to provide decorative coloring to the gymnasium both when the bleachers are retracted and when in use. Nor need the cushions be removed before the bleachers can be extended for seating. In both cases the cushions "dress up" damaged or tarnished bleacher faces and seats, improve acoustics in the gymnasium, and reduce noise. When the bleachers are retracted the protection provided by the cushions is significantly greater than that provided by conventional wall padding. The cushions can even be attached directly to a gymnasium wall, say between sets of bleachers or otherwise, to afford increased protection. Indeed, the cushions can be advantageously used in fixed bleachers, indoors or out-of-doors, and are constructed so that out-of-doors they can be removed during winter or other idle months of the year.

Other features and advantages of the invention will become apparent from the drawings and the more detailed description which follows.

DETAILED DESCRIPTION OF THE PREFERRED EMBODIMENT

Figure 1:
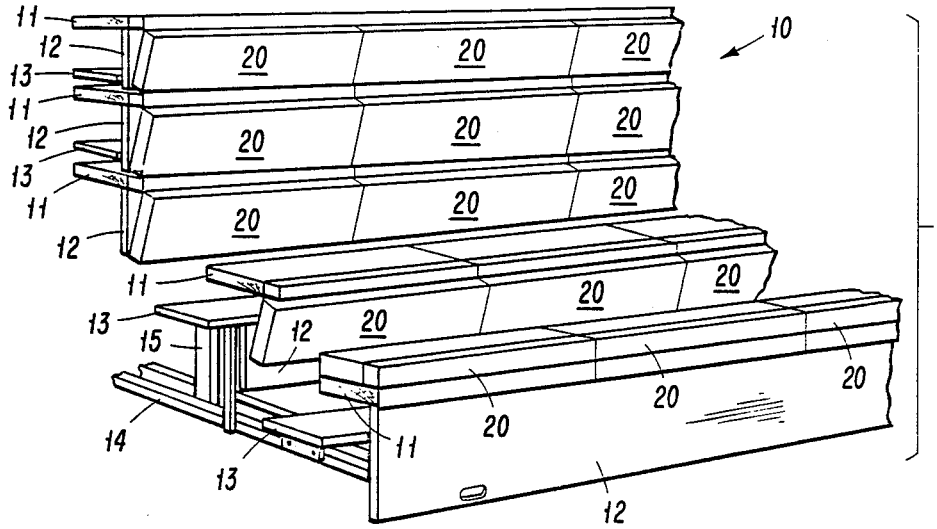
FIG. 1 depicts a section of typical retractable bleachers with the cushions of the invention attached thereto, the upper three tiers being retracted with the cushions in their protective position, while the lower-most tier is extended with the cushions in their seating position.
Figure 4:
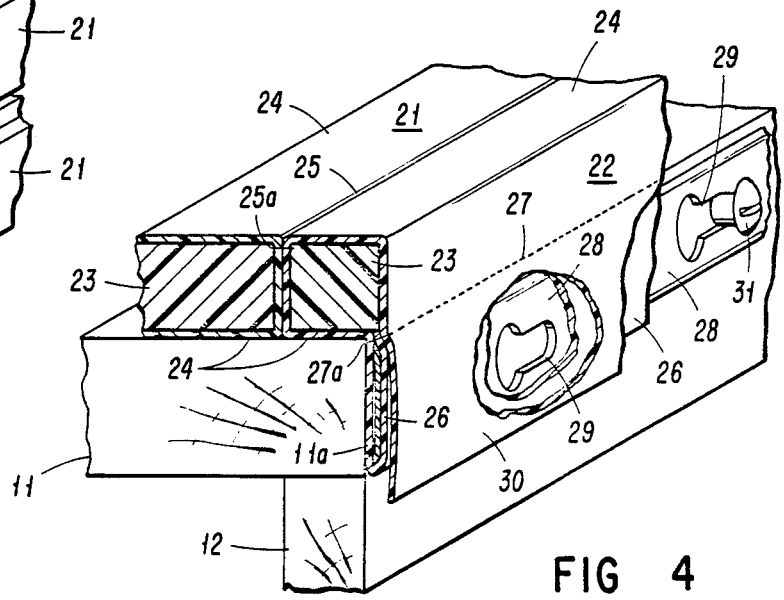
FIG. 4 is a sectional detail of the cushions taken along the line 4—4 of FIG. 2.

In FIG. 1 the bleachers 10 include longitudinally extending seats 11, risers 12 and foot rests 13, all in this case of wood as is typical and all supported from telescoping rails 14 and uprights 15 (only a few of which are shown). Each cushion assembly 20 includes a relatively wide cushion 21 and a relatively narrow cushion 22 of substantially equal lengths and thicknesses, the overall width of the two cushions 21 and 22 being substantially equal to that of the seats 11. The cushions 21 and 22 each consist of a compressible urethane core 23 enclosed by vinyl impregnated nylon sheet material 24 sewn together about the urethane cores 23. The two cushions 21 and 22 longitudinally abut each other and are hinged together at 25 by stitching 25*a* along one pair of their abutting corners, as shown in FIG. 4. The longitudinally diagonally opposite corner of the cushion 22 from the hinge 25 is formed with a depending, longitudinally extending envelope flap 26 of the nylon material, equal in length to the cushions 21 and 22 and hinged thereto at 27 by stitching 27*a*. The envelope flap 26 contains seat attachment means which may take the form of a strip of metal 28, the envelope flap 26 and the strip 28 having a series of horizontal keyhole-shaped slots 29 therethrough regularly spaced along their length. The stitching 27*a* also secures a cover flap 30, formed as shown in FIG. 4 by a depending extension of the nylon material of the cushion 22, which flap 30 overlies the envelope flap 26 when the cushion assemblies 20 are installed. Installation involves imply a series of headed pins or screws 31 into the front faces 11*a* of the seats 11, the screws 31 being spaced equally with the slots 29. Each cushion assembly 20 is then engaged with the screws 31 and slid sideways so the screws 31 enter the necked-down portions of the slots 29. The screws 31 may then be tightened if desired.

Figure 2:
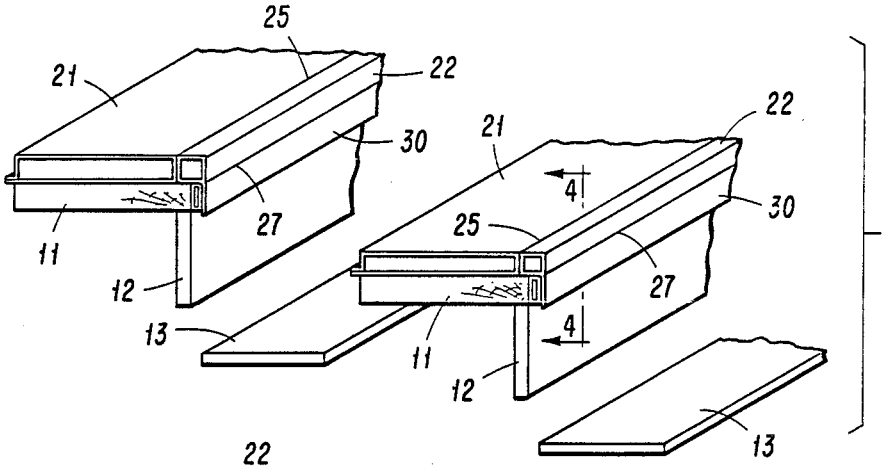
FIG. 2 illustrates an enlarged portion of an extended section of the bleachers of FIG. 1 with the cushions in their seating position.
Figure 3:
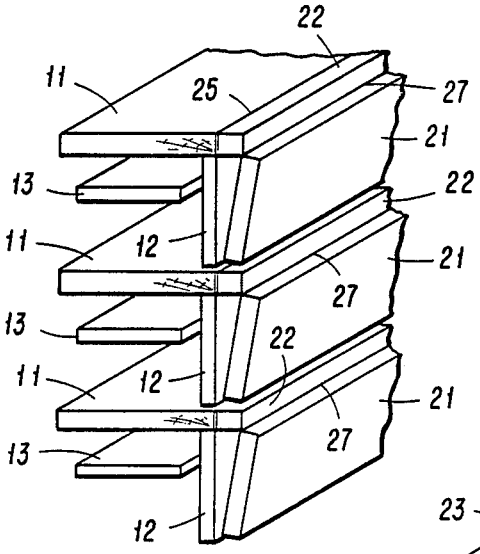
FIG. 3 shows an enlarged portion of a retracted section of the bleachers of FIG. 1 with the cushions in their protective position.

When the cushion assemblies 20 are positioned as shown in FIGS. 2 and 4 they provide comfortable, decorative seats for spectators on the bleachers when extended. When flipped-down about their hinges 25 and 27 to the position shown on the upper four tiers of FIG. 1 and in FIG. 3, and the bleachers are afterwards retracted, the two cushions 21 and 22 of each assembly 20 hand down over the seat faces 11*a* and the risers 12. An upright wall of cascading tiers of decorative, protective padding is thus formed offering substantially greater safety than typical gymnasium wall padding, owing especially to the spaces between the risers 12 and cushions 21. Removal, in case that should be desired, involves simply loosening the screws 31, sliding each cushion assembly 20 sideways to disengage its slots 29. In practice the assemblies 20 are normally manufactured in convenient three-foot lengths, long enough for two persons sitting side-by-side, and in shorter lengths where needed to fill out a row of seats. Note that in the case of retractable bleachers the cushions 20 must be flipped-down to their protective position before the bleachers can be retracted. Hence the overall width of each cushion assembly 20 normally cannot be greater than the combined heights of a seat 11 and a riser 12 in order not to interfere with the rearward movement of the seat 11 immediately below when the bleachers are retracted since typically there is then little clearance between a seat 11 and riser 12, as will be evidence from FIGS. 1 and 3. When made in alternate or school colors a variety of pleasing patterns can be arranged to ornament the bleachers in both their retracted and extended positions.

When the bleachers are extended the cushions 20 are left flipped-down. This allows spectators to run along the bare seats 11, as they are wont to do, without trodding on the cushions 20 which are then flipped-up as needed for seating. Indeed, if the bleachers are not crowded on occasion, it has been found that spectators sitting on one row of cushions 20 often use the flipped-down cushions 20 immediately behind them as back rests. When fitted to fixed bleachers indoors or out-of-doors the cushions 20 are also normally left flipped-down for the same reasons. Even on fixed bleachers the flipped-down cushions 20 provide some protection to players in the gym or on the field. Note that when out-of-doors the flipped-down cushions 20 shield their seat faces from the elements so that when flipped-up spectators have dry seating.

Though the present invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. A cushion assembly for use on bleachers, the assembly comprising first and second compressible members having substantially equal lengths and thicknesses and substantially rectangular in cross-section, the width of the first member being substantially greater than the width of the second member, the two cushion members abutting each other longitudinally and hinged to each other along a pair of their abutting longitudinal corners, the longitudinal corner of the second member diagonally opposite said hinge having means for hingedly securing the cushion assembly to the front face of a longitudinal extending seat member.

2. The cushion assembly of claim 1 wherein the securing means includes a first flap of flexible material of a length substantially equal to the length of the cushion assembly.

3. The cushion assembly of claim 2 wherein the securing means includes means effective for removably attaching the first flap to said seat member face.

4. The cushion assembly of claim 3 wherein the first flap comprises a longitudinally extending envelope of said material enclosing a non-compressible longitudinally extending member having a plurality of longitudinally spaced, longitudinally extending slots therethrough having corresponding first and second opposite ends, each of the first slot ends having a larger aperture than the aperture of each of the second slot ends.

5. The cushion assembly of claim 4 including a second flap of flexible material of a length substantially equal to the length of the cushion assembly and hinged along a longitudinal edge thereof at said hinge of the first flap, the second flap being effective to overlie the first flap when the cushion assembly is secured to said seat member face.

* * * * *